US011446955B2

(12) United States Patent
Eifes et al.

(10) Patent No.: US 11,446,955 B2
(45) Date of Patent: Sep. 20, 2022

(54) PENCIL SHARPENER FOR CARPENTERS

(71) Applicant: SAFETY NAILER LLC, Yorktown, VA (US)

(72) Inventors: Kristen Eifes, Yorktown, VA (US); Daniel Eifes, Yorktown, VA (US); Cori Zirkle, Virginia Beach, VA (US); Drew Zirkle, Virginia Beach, VA (US)

(73) Assignee: SAFETY NAILER LLC, Yorktown, VA (US)

( * ) Notice: Subject to any disclaimer, the term of this patent is extended or adjusted under 35 U.S.C. 154(b) by 0 days.

(21) Appl. No.: 17/010,533

(22) Filed: Sep. 2, 2020

(65) Prior Publication Data

US 2021/0078356 A1 Mar. 18, 2021

Related U.S. Application Data

(60) Provisional application No. 62/899,278, filed on Sep. 12, 2019.

(51) Int. Cl.
*B43L 23/00* (2006.01)
*B43L 23/08* (2006.01)

(52) U.S. Cl.
CPC ..... *B43L 23/08* (2013.01)

(58) Field of Classification Search
CPC ..... B43L 23/08
See application file for complete search history.

(56) References Cited

U.S. PATENT DOCUMENTS

| | | | | |
|---|---|---|---|---|
| 1,858,891 | A * | 5/1932 | Smith | B43L 23/02 144/28.4 |
| 6,092,293 | A | 7/2000 | Donaldson | |
| 6,397,479 | B1 * | 6/2002 | Luttgens | B43L 23/08 144/28.11 |
| 6,571,480 | B1 | 6/2003 | Qiu | |
| 8,656,600 | B2 | 2/2014 | Hammer | |
| 8,726,527 | B2 * | 5/2014 | Constantine | B43L 23/008 30/453 |
| 2005/0257386 | A1 * | 11/2005 | Luttgens | B43L 23/08 30/451 |
| 2005/0257387 | A1 * | 11/2005 | Luttgens | B43L 23/08 30/456 |
| 2006/0080846 | A1 * | 4/2006 | Luttgens | B43K 29/004 30/451 |
| 2007/0062049 | A1 | 3/2007 | Kern | |
| 2015/0224816 | A1 * | 8/2015 | Weiland | B43L 23/04 30/453 |

* cited by examiner

*Primary Examiner* — Omar Flores Sanchez
(74) *Attorney, Agent, or Firm* — Cantor Colburn LLP

(57) ABSTRACT

A pencil sharpener is provided. The pencil sharpener comprising: a sharpener body configured to sharpen a pencil when inserted and rotated; a first guide rotationally coupled to the sharpener body, the first guide having a first opening sized and shaped to receive a circular, hexagon or oval pencil; and a second guide rotationally coupled to the sharpener body, the second guide assembly having a second opening sized and shaped to receive a circular, hexagon or oval pencil, the second opening being aligned with the first opening when the pencil is inserted through both the first opening and the second opening.

10 Claims, 6 Drawing Sheets

PENCIL SHARPENER FOR CARPENTERS

CROSS REFERENCE TO RELATED APPLICATIONS

This application claims the benefit of U.S. Provisional Application Ser. No. 62/899,278, filed Sep. 12, 2019, the entire disclosure of which is incorporated herein by reference.

BACKGROUND

The subject matter disclosed herein relates to a pencil sharpener, such as a pencil sharpener used by carpenters.

Carpenters use pencils of a variety of shapes, such as circular, hexagon or oval. This requires that the carpenter carry multiple sharpeners that are often misplaced or not conveniently available when needed. Further, conventional pencil sharpeners require two hands to operate, meaning that the carpenter needs to put down the workpiece before sharpening the pencil.

Accordingly, while existing pencil sharpeners are suitable for their intended purposes the need for improvement remains, particularly in providing a pencil sharpener with the features described herein.

BRIEF DESCRIPTION

According to one aspect of the disclosure, a pencil sharpener is provided. The pencil sharpener comprising: a sharpener body configured to sharpen a pencil when inserted and rotated; a first guide rotationally coupled to the sharpener body, the first guide having a first opening sized and shaped to receive a circular, hexagon or oval pencil; and a second guide rotationally coupled to the sharpener body, the second guide assembly having a second opening sized and shaped to receive a circular, hexagon or oval pencil, the second opening being aligned with the first opening when the pencil is inserted through both the first opening and the second opening.

According to another aspect of the disclosure, another pencil sharpener is provided. The pencil sharpener having a holder tray and a top guide body operably coupled to the holder tray. A sharpener body is coupled to the holder tray, the sharpener body having a first opening sized to receive a pencil. A blade is coupled to the sharpener body and arranged to cooperate with the first opening to sharpen the pencil when the pencil is rotated within the opening. A first guide is rotationally coupled to the top guide body, the first guide having a second opening sized and shaped to receive a circular, hexagon, octagonal, rectangular, or oval pencil. A second guide is rotationally coupled to the sharpener body, the second guide assembly having a third opening sized and shaped to receive a circular, hexagon, octagonal, rectangular, or oval pencil, the third opening being aligned with the first opening and the second opening when the pencil is inserted through both the second opening and the third opening.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

Figure 1:
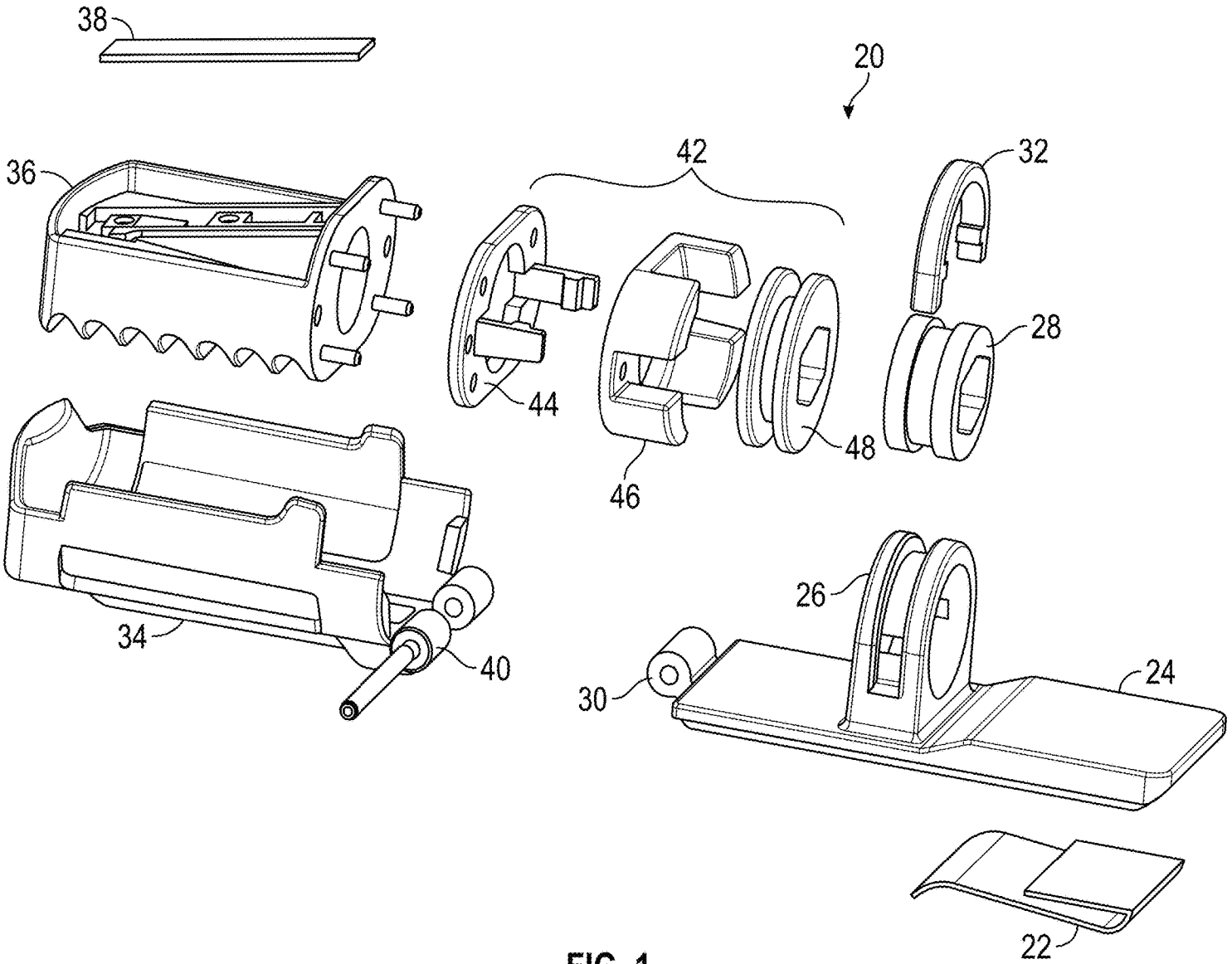
FIG. 1 is an unassembled view of a pencil sharpener for carpenters in accordance with an embodiment.
Figure 2:
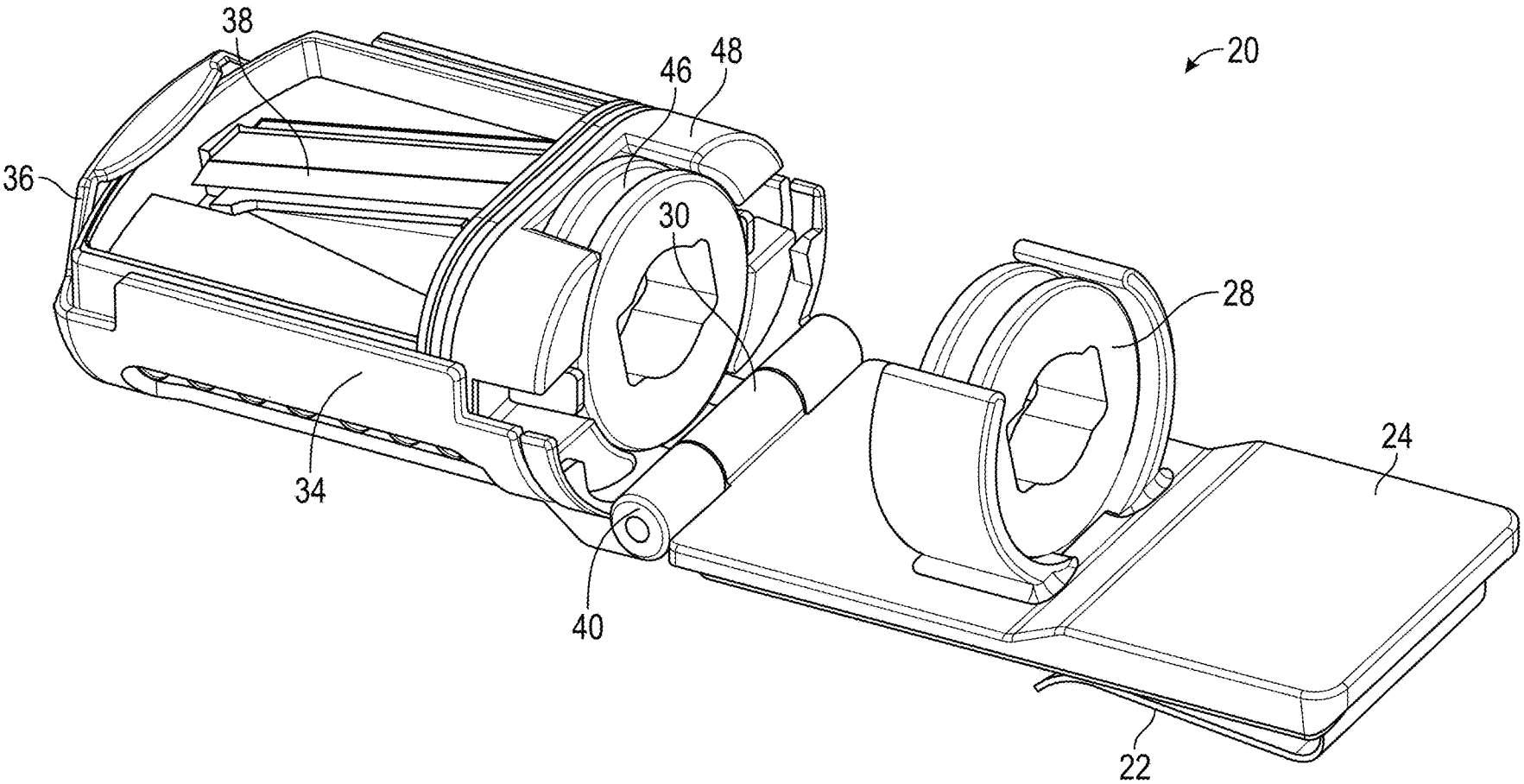
FIG. 2 is a top perspective view of the sharpener of FIG. 1.
Figure 3:
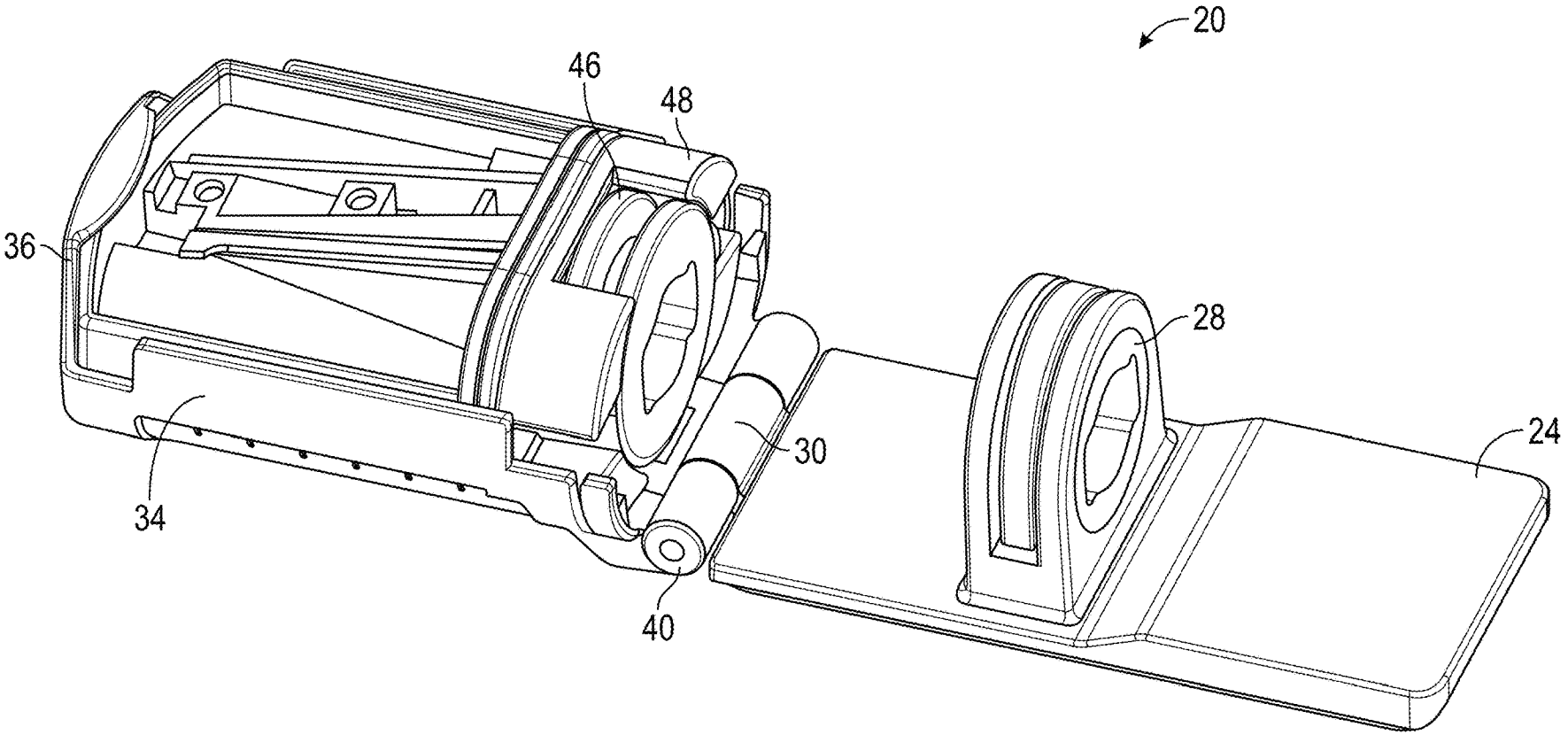
FIG. 3 is another top perspective view of the sharpener of FIG. 1.
Figure 4:
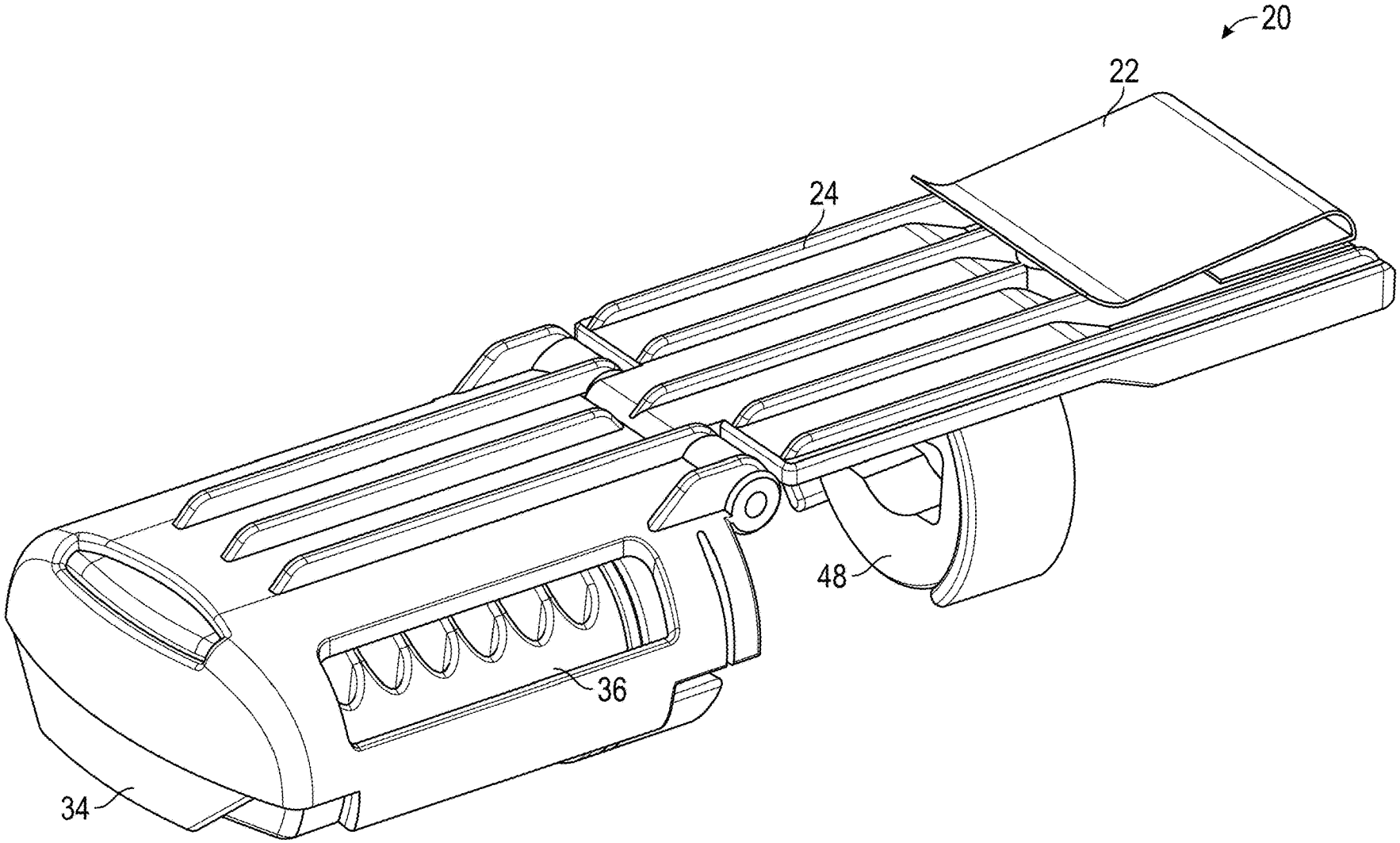
FIG. 4 is a bottom perspective view of the sharpener of FIG. 1.

The detailed description explains embodiments of the disclosure, together with advantages and features, by way of example with reference to the drawings.

DETAILED DESCRIPTION

Embodiments of the present disclosure provide for a pencil sharpener, such as that used to sharpen pencils used by carpenters. The sharpener provides for sharpening pencils that are standard round or hexagon shaped, octagonal sharpened, rectangular, or that are oval. In some embodiments, the sharpener includes a clip allowing the user to attach the sharpener to a belt, an article of clothing, a tool box or another thin walled article.

The sharpener 20 consists of a clip 22 coupled to a top guide body 24. The top guide body 24 includes a projection 26 having an opening sized to receive a top guide 28. One end of the top guide body includes a hinge means 30, such as a door style hinge. In an embodiment, the top guide 28 is secured by a clip 32. In an embodiment, the clip includes a pair of opposing projections that extend through openings in the projection 26 to engage a circular slot in the top guide.

The top guide body 24 is rotationally coupled to holder tray 34 that has a slot shaped to engage and couple with a sharpener body 36. The sharpener body 36 includes a blade member 38 that is positioned to engage the pencil when it is inserted into an opening in the sharpener 20. The holder tray 34 includes hinge means 40 that cooperates with the hinge means 30 to rotationally couple the holder tray 34 to the top guide body 24.

Coupled to the sharpener body 36 is a lower guide member assembly 42. The assembly 42 includes a clip 44 that is coupled to the sharpener body 36, a holder 46 that is coupled to the sharpener body 36 and includes a recess sized to receive a lower guide member 48. In an embodiment, the clip 44 includes a pair of arms that have tabs which engage a slot in the lower guide member 48 to retain the lower guide member in the recess of the holder 46 while allowing the lower guide member 48 to rotate.

In an embodiment, the sharpener 20 will consist of a sharpener for carpenter pencils that are rectangular (e.g. having two long flat sides with curved or faceted ends) or oval in shape and standard pencils that are round, hexagonal or octagonal in shape. In an embodiment, this is accomplished by having an opening in the guide members 28, 48 that accommodates both sizes. In an embodiment, the opening in guide members 28, 48 has a circular center portion with a pair of opposing slots. It should be appreciated that the slots allow a rectangular or oval pencil to be inserted into the guide members 28, 48. The pencil sharpener attaches to a holder tray. In another embodiment, the sharpener does not fit in the tray but is configured with a clip hinge or rotational hinge clip assembly so the sharpener couples directly to the top guide body 24 without the use of the tray 34.

Figure 5:
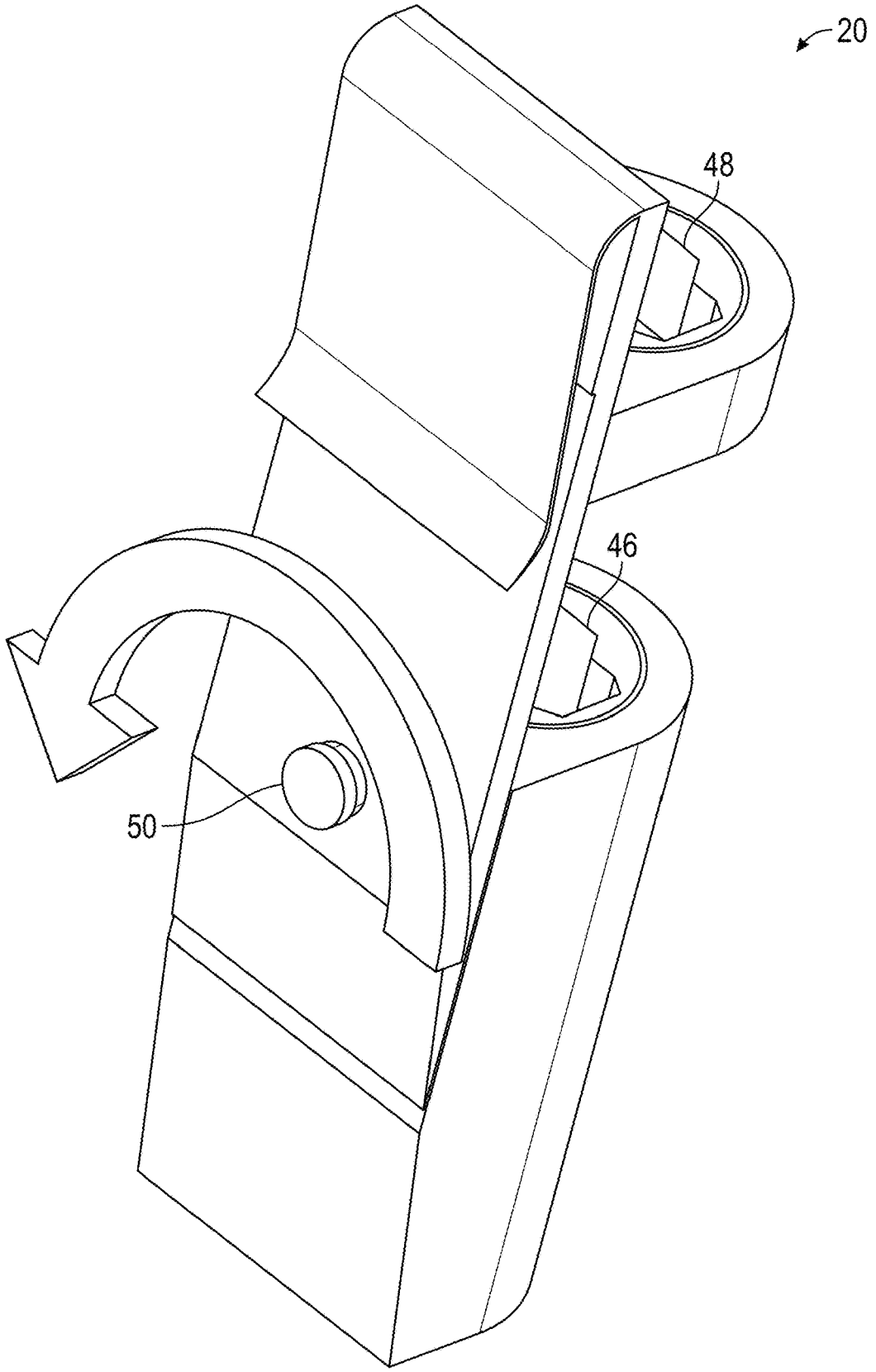
FIG. 5 is schematic illustration depicting a sharpener for carpenters in accordance with another embodiment.

In an embodiment, the pencil sharpener holder tray is attached to the rotational guide and belt clip rigid body via a hinge. The hinge may be that of a door style (shown in picture) or of that of a rotational hinge as the pencil sharpener and tray may rotate forward or backwards. The hinge may also be a ball in socket joint 50 to allow the sharpener and tray to rotate freely 360 degrees as is shown in FIG. 5.

The hinge or joint 50 is desired as to move or rotate the sharpener to a position to sharpen shorter pencils. Pencils may be sharpened by the sharpener without the top rotational guide when the pencils are too short to sharpen in the device while utilizing the lower rotational guide which is above the sharpener.

In an embodiment, adjacent to or above the rotational entry hole of the lower guide member for the pencil will be another rotational hole to act as a guide. (the top rotational guide). This will allow the user to hold their pencil on a belt and sharpen their pencil with one hand by rotating it in the device. It should be appreciated that this provides advantages in that the user does not need to release or let go of the workpiece while they sharpen their pencil. Further, the rotational guide will help keep the pencil in the device more securely and additionally help the pencil stay centered in the sharpener for more efficient sharpener.

In an embodiment, the top rotational guide is attached to the same rigid body that is attached to a belt clip. This belt clip will be that type of a rotational belt clip, if the user wants to rotate the product forward or backwards to avoid the pencil poking in his side.

Figure 6:
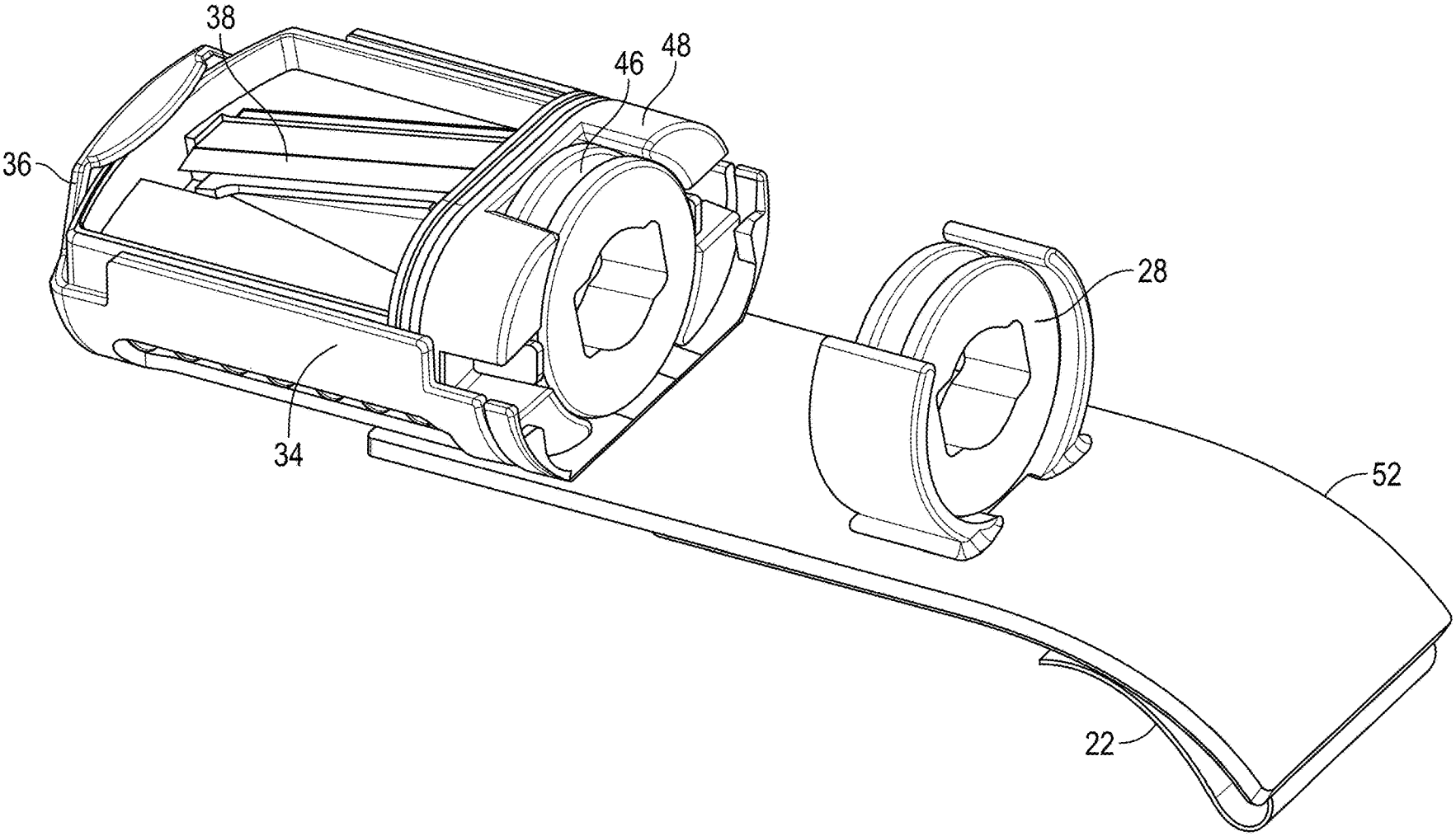
FIG. 6 is a top perspective view of a pencil sharpener for carpenters in accordance with another embodiment.

Referring now to FIG. 6 another embodiment is shown of the pencil sharpener. In this embodiment, the holder tray 34, projection 26 and clip 22 are each coupled to a flexible member 52. In an embodiment, the holder tray 34, projection 26, and clip 22 are coupled to the flexible member 52 by rivets or adhesive (not shown). In an embodiment, the flexible member 52 replaces the top guide body 24 and hinge 40. The flexible member 52 is made from a material, such as leather for example, that durable and sufficiently rigid to hold the holder tray 34, and projection 26 such that the openings in the guide members 28, 48 are aligned to receive the pencil. The flexibility of the material provides advantages in allowing the pencil sharpener to be coupled to the users belt and not interfere with their movement.

The term "about" is intended to include the degree of error associated with measurement of the particular quantity based upon the equipment available at the time of filing the application.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A pencil sharpener comprising:

a sharpener body configured to sharpen a pencil when inserted and rotated;

a holder tray coupled to the sharpener body;

a first guide rotationally coupled to the sharpener body, the first guide having a first opening sized and shaped to receive a circular, hexagon, octagonal, rectangular, or oval pencil, the first opening includes a first circular center portion and a pair of opposing first slots;

a top guide body operably coupled to the first guide, the top guide body coupled to the holder tray by a hinge;

a second guide rotationally coupled to the sharpener body, the second guide assembly having a second opening sized and shaped to receive a circular, hexagon, octagonal, rectangular, or oval pencil, the second opening being aligned with the first opening when the pencil is inserted through both the first opening and the second opening, the second opening includes a second circular center portion and a pair of opposing second slots.

2. A pencil sharpener comprising:

a sharpener body configured to sharpen a pencil when inserted and rotated;

a first guide rotationally coupled to the sharpener body, the first guide having a first opening sized and shaped to receive a circular, hexagon, octagonal, rectangular, or oval pencil;

a second guide rotationally coupled to the sharpener body, the second guide assembly having a second opening sized and shaped to receive a circular, hexagon, octagonal, rectangular, or oval pencil, the second opening being aligned with the first opening when the pencil is inserted through both the first opening and the second opening;

a top guide body operably coupled to the first guide, the top guide body further being at least partially movably coupled to the holder tray;

wherein the top guide body is made from a flexible material.

3. The pencil sharpener of claim 2, wherein the flexible material is leather.

4. The pencil sharpener of claim 1, further comprising a clip coupled to the top guide body.

5. A pencil sharpener comprising:

a holder tray;

a top guide body operably coupled to the holder tray, the top guide body is made from a flexible material;

a sharpener body coupled to the holder tray, the sharpener body having a first opening sized to receive a pencil;

a blade coupled to the sharpener body and arranged to cooperate with the first opening to sharpen the pencil when the pencil is rotated within the opening;

a first guide rotationally coupled to the top guide body, the first guide having a second opening sized and shaped to receive a circular, hexagon, octagonal, rectangular, or oval pencil; and, a second guide rotationally coupled to the sharpener body, the second guide assembly having a third opening sized and shaped to receive a circular, hexagon, octagonal, rectangular, or oval pencil, the third opening being aligned with the first opening and the second opening when the pencil is inserted through both the second opening and the third opening.

6. The pencil sharpener of claim 5, wherein the top guide body is made from leather.

7. The pencil sharpener of claim 5, wherein the second guide comprises:

a holder coupled to the sharpener body;

a first clip disposed between the holder and the sharpener body; and a lower guide disposed within the holder and rotationally coupled to the sharpener body by the clip.

8. The pencil sharpener of claim 5, wherein the first guide further includes a second clip having a pair of projections that engage a circular slot on the top guide.

9. The pencil sharpener of claim 8, wherein the first clip includes a pair of arms having a tabs that engage a slot on the lower guide.

10. The pencil sharpener of claim 5, further comprising a clip coupled to the top guide body on a side opposite the first guide.

* * * * *